US006434905B1

(12) United States Patent
Sprague

(10) Patent No.: US 6,434,905 B1
(45) Date of Patent: Aug. 20, 2002

(54) DOOR RAIL SYSTEM

(75) Inventor: Gary Sprague, Hermosa Beach, CA (US)

(73) Assignee: C. R. Laurence Co., Inc., Gardena, CA (US)

( * ) Notice: Subject to any disclaimer, the term of this patent is extended or adjusted under 35 U.S.C. 154(b) by 0 days.

(21) Appl. No.: 09/631,148

(22) Filed: Aug. 2, 2000

(51) Int. Cl.[7] ..... E04B 9/00

(52) U.S. Cl. ..... 52/474; 52/775; 52/35; 52/127.8; 52/825; 49/501

(58) Field of Search ..... 52/204.56, 204.64, 52/204.65, 204.67, 766, 767

(56) References Cited

U.S. PATENT DOCUMENTS

| | | | | |
|---|---|---|---|---|
| 981,672 A | | 1/1911 | Bonness | |
| 984,384 A | | 2/1911 | McElaney et al. | |
| 1,083,865 A | | 1/1914 | Sloss | |
| 1,507,769 A | | 9/1924 | Disbro | |
| 3,789,564 A | | 2/1974 | Kessler | |
| 3,802,143 A | | 4/1974 | Adler et al. | |
| 4,235,049 A | | 11/1980 | Marinoni et al. | |
| 4,418,506 A | | 12/1983 | Weber et al. | |
| 4,423,582 A | * | 1/1984 | Yates | 52/825 |
| 4,550,542 A | | 11/1985 | La See | |
| 4,655,025 A | | 4/1987 | Marinori | |
| 4,671,016 A | * | 6/1987 | Boeckx | 49/501 |
| 4,680,903 A | * | 7/1987 | Horgan, Jr. | 52/127.8 |
| 4,835,927 A | | 6/1989 | Michlovic | |
| 4,920,717 A | | 5/1990 | Hooper, Jr. | |
| 5,069,010 A | | 12/1991 | Trainor, Jr. et al. | |
| 5,356,675 A | | 10/1994 | Unger et al. | |
| 5,444,958 A | * | 8/1995 | Lu | 52/775 |
| 5,483,775 A | | 1/1996 | Redman | |
| 5,666,692 A | | 9/1997 | Toledo | |
| 5,694,722 A | * | 12/1997 | Husting et al. | 52/35 |
| 5,857,298 A | | 1/1999 | Fullwood | |
| 6,014,846 A | | 1/2000 | Sono et al. | |

FOREIGN PATENT DOCUMENTS

| | | |
|---|---|---|
| IT | 300053 | 8/1932 |

OTHER PUBLICATIONS

Information Sheet on GCC Door Rail Systems 2 pages.

* cited by examiner

*Primary Examiner*—Carl D. Friedman
*Assistant Examiner*—Steve M Varner
(74) *Attorney, Agent, or Firm*—Luce, Forward, Hamilton & Scripps LLP

(57) ABSTRACT

A rail system for holding a panel, such as a plate glass pane, in a door and/or wall partition. The rail system includes a housing and a clamp member having a wedging geometry so that when the clamp member is actuated with respect to the housing in a first direction, at least a portion of the clamp member will move in a clamping direction, which is different than the first direction to clamp the panel.

2 Claims, 7 Drawing Sheets

DOOR RAIL SYSTEM

The present invention is directed to rail systems for holding panels in place, and more particularly to door and/or partition rail systems for holding a plate glass pane in a doorway and/or wall partition.

BACKGROUND OF THE INVENTION

Rail systems are conventionally used to hold plate glass panels or panes (or other transparent, translucent or opaque panels) in a doorway opening or for use as a wall partition. Usually, the rail system runs along one or more edges of the panel and secures the panel at its edges. Preferably, the rail system includes an accessory channel space to hold miscellaneous door frame hardware, such as locking hardware, pivots and hardware related to hydraulic closure devices.

In many prior art rail systems, such as those typically used in the doors of shopping malls, the rail is permanently attached to the pane. Of course, this makes it difficult or impossible to remove the rail from the pane, and this is generally considered to be a disadvantage of these permanent attachment designs. Also, in these permanent attachment designs, it is conventionally the glass supplier who convenytionally makes the permanent connection between the pane and the rail assembly. This means that the on-site glazier or door installer is dependent on the off-site glass supplier, which is disadvantageous, at least from the perspective of glaziers and installers.

However, FIG. 1 shows a prior art rail system 10, as described in U.S. Pat. No. 5,069,010 (herein incorporated by reference), wherein the pane can be assembled with and disassembled from the rail. More particularly, rail system 10 generally includes tempered glass door pane 11 and rail assembly 12. Rail assembly 12 defines and accommodates accessory channel space 14. Screw 16 is tightened to cause assembly 12 to clamp and thereby secure the edge of pane 11. Screw 16 is loosened to remove pane 11 from rail assembly 12. Screw 16 is tightened and loosened by accessing its head via access port 56.

SUMMARY OF THE INVENTION

The present application deals with some potential problems in the above described prior art and some potential solutions to these potential problems. One potential problem with the door rail system of described U.S. Pat. No. 5,069,010 is that the hole in the side of the rail caused by access port 56 is not considered aesthetically appropriate for many applications. While it is necessary to cover the sides of the rail with some type of cladding, such as an aluminum plate, this adds expense, and makes the rail system more difficult to assemble and disassemble.

Another potential problem with the rail system of U.S. Pat. No. 5,069,010 is that accessory channel space 14 is formed by two separate pieces. These two separate pieces are separate because they clamp and unclamp to allow assembly with and disassembly from a pane. While it is advantageous that the rail system of U.S. Pat. No. 5,069,010 can be assembled with and disassembled from the pane, it is unfortunate that the accessory channel is defined by separate pieces because this means that hardware components in the accessory channel, which are attached to both sides of the accessory channel 14 require disassembly from the accessory channel before the accessory channel can be separated into its two defining pieces in order to allow the rail system to be removed from the pane.

To put it a little more simply, the rail system of U.S. Pat. No. 5,069,010 must be disassembled before it can be removed from a door. For similar reasons, and perhaps more importantly, hardware cannot be fully installed in accessory channel 14 until the rail system of U.S. Pat. No. 5,069,010 is assemble with the pane. While these assembly and disassembly difficulties are subtle, they can add significantly to the time required for a glazier or installer to do assembly and disassembly procedures.

Another problem is that the prior art systems require periodic maintenance (tightening) for proper operation. In many systems, simple tightening operations require removal of the door or panel and sometimes require partial disassembly of the rail.

Also, it is desirable to increase the clamping force and stability over what can be achieved by the rail system of U.S. Pat. No. 5,069,010. Furthermore, it is desirable to optimize the distribution of the clamping force along the portion of the pane that is held captive in the clamping hardware.

At least some embodiments of the present invention can solve these problems and associated opportunities for improvement.

At least some embodiments of the present invention may exhibit one or more of the following objects, advantages and benefits:

(1) to provide a rail system with an accessory channel;

(2) to provide a rail system with more stable clamping force;

(3) to provide a rail system with continuous and aesthetically-attractive exposed surfaces;

(4) to provide a rail system that does not require cladding to be placed over the exposed surfaces of the rails;

(5) to provide a rail system that takes advantage of taper locking forces;

(6) to provide a rail system wherein the weight of the pane causes forces that accentuate the clamping forces on the pane;

(7) to provide a rail system wherein the distribution of clamping force on the pane is optimized;

(8) to provide a rail system that is easier to assemble and disassemble because of easy accessibility of fastening members (eg, screw heads);

(9) to provide a rail system that can more easily accommodate panes of different thicknesses;

(10) to provide a rail system that facilitates easy field maintenance and replacement;

(11) to provide a rail system that can be assembled with a pane by door installers and/or glaziers; and

(12) to provide a rail system that is removable from a pane without disassembly of the rail system.

According to one aspect of the present invention, a rail system for securing a panel includes a housing, at least one clamp and actuation hardware. The housing has a mating surface. The at least one clamp member is shaped and structured to clamp onto the panel. The at least one clamp member also has a mating surface located to be in contact with the mating surface of the housing. The actuation hardware is structured to drive the clamp member to move relative to the housing in a driven direction. The mating surface of the housing and the mating surface of the clamp member are inclined relative to this driven direction so that at least a portion of the clamp member will move in a clamping direction, which is different than the driven direction, when the clamp member is driven in the driven direction by the actuation hardware.

According to a second aspect of the present invention, a rail system for releasably securing a pane oriented in a vertical direction includes an elongated housing, a first clamp member, a second clamp member, a screw and a nut. The elongated housing includes a first inclined surface and a second inclined surface. The first inclined surface of the elongated housing is oriented to be generally inclined with respect to the vertical direction. The second inclined surface of the elongated housing is oriented to be generally inclined with respect to the vertical direction. The first clamp member includes an inclined surface and a pane clamping surface. The inclined surface of the first clamp member is located adjacent to the first inclined surface of the housing and is oriented to be approximately parellel to the first inclined surface of the housing. The second clamp member includes an inclined surface and a pane claimping surface. The inclined surface of the second clamp member is located adjacent to the second inclined surface of the housing and oriented to be approximately parellel to the second inclined surface of the housing. The nut is threadably engaged with the screw and located to drive the first and second clamp members in the vertical direction when the screw is rotated.

Further applicability of the present invention will become apparent from a review of the detailed description and accompanying drawings. It should be understood that the description and examples, while indicating preferred embodiments of the present invention, are not intended to limit the scope of the invention, and various changes and modifications within the spirit and scope of the invention will become apparent to those skilled in the art.

BRIEF DESCRIPTION OF THE DRAWINGS

The present invention will become more fully understood from the detailed description given below, together with the accompanying drawings which are given by way of illustration only, and are not to be construed as limiting the scope of the present invention. In the drawings.

DETAILED DESCRIPTION OF THE PREFERRED EMBODIMENTS

Before plunging into a description of the Figures, some terms will now be defined.

Surface: The word surface is not limited to planer, regular or continuous surfaces but is rather to be construed broadly to include any surface including irregular or curved surfaces.

Inclined: Inclined means generally at an angle to. On occasion, a surface (which may not be perfectly planer) will describe as being inclined. Such a surface can be inclined with respect to something else, even though the curvature or irregularity in the surface may make it possible to observe only an approximate angle, rather than a precisely-defined mathematical angle (which would require a perfectly straight line or surface).

Screw: As used herein, screws refer to any threaded member. Screws are not required to have screw heads, although this is preferable.

Nut: As used herein, a nut is any piece having one or more threaded holes. For example, nut strips, further described below, are herein considered to be an example of a nut.

To the extent that a patentee may act as its own lexicographer under applicable law, it is hereby directed that all words appearing in the claims section, except for the above-defined words surface, inclined, screw and nut, shall take on their ordinary, plain and accustomed meanings (as generally evidenced, inter alia, by dictionaries and/or technical lexicons), and shall not be considered to be specially defined in this specification.

Figure 1:
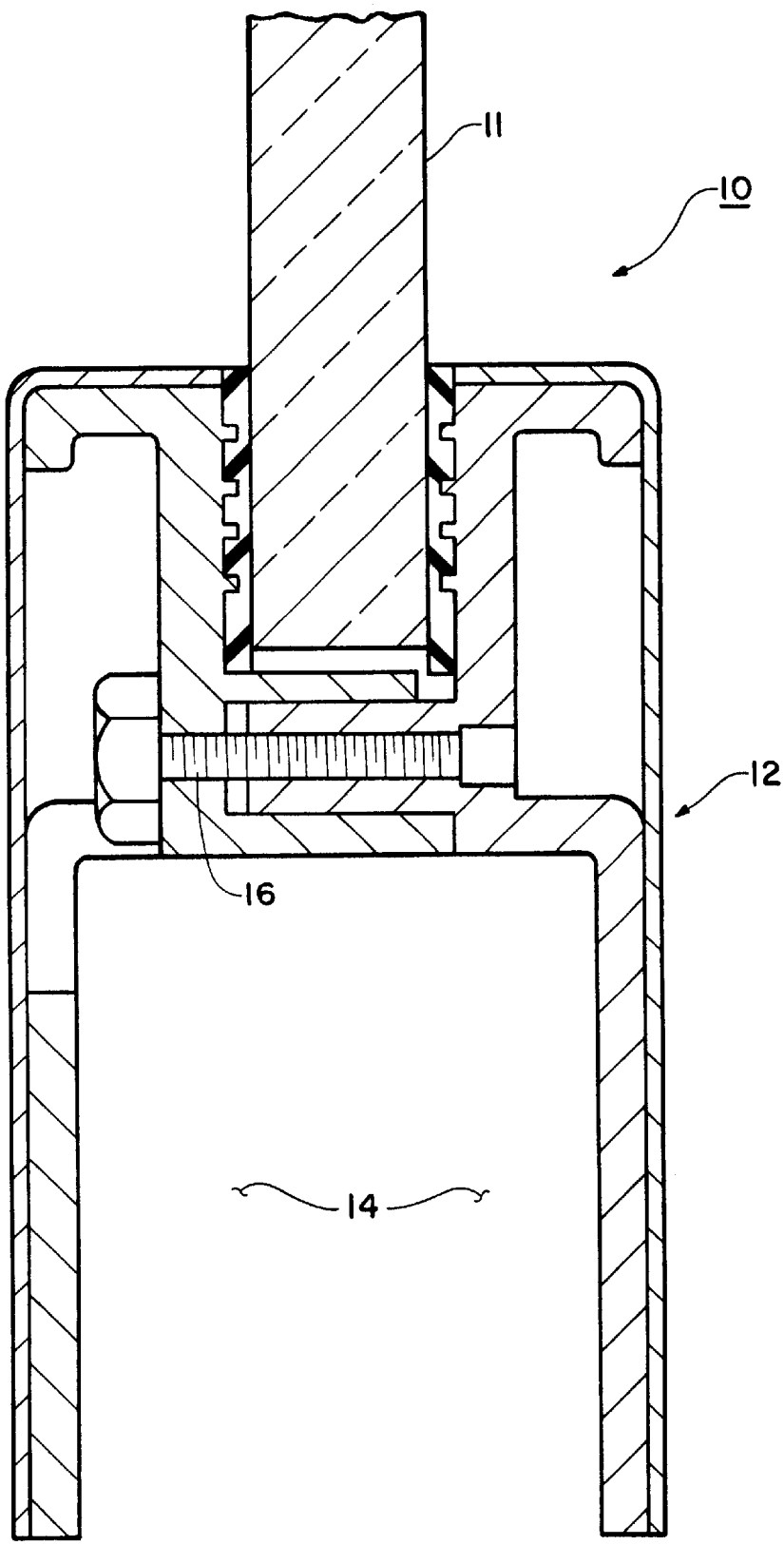
FIG. 1 (PRIOR ART)
FIG. 1 is a transverse cross-sectional view of a prior art rail system.

FIG. 1 shows an exemplary prior art rail system. More particularly, as discussed above, prior art rail system 10 includes pane 11, rail assembly 12, accessory channel space 14, screw 16 and access port 56.

Figure 2:
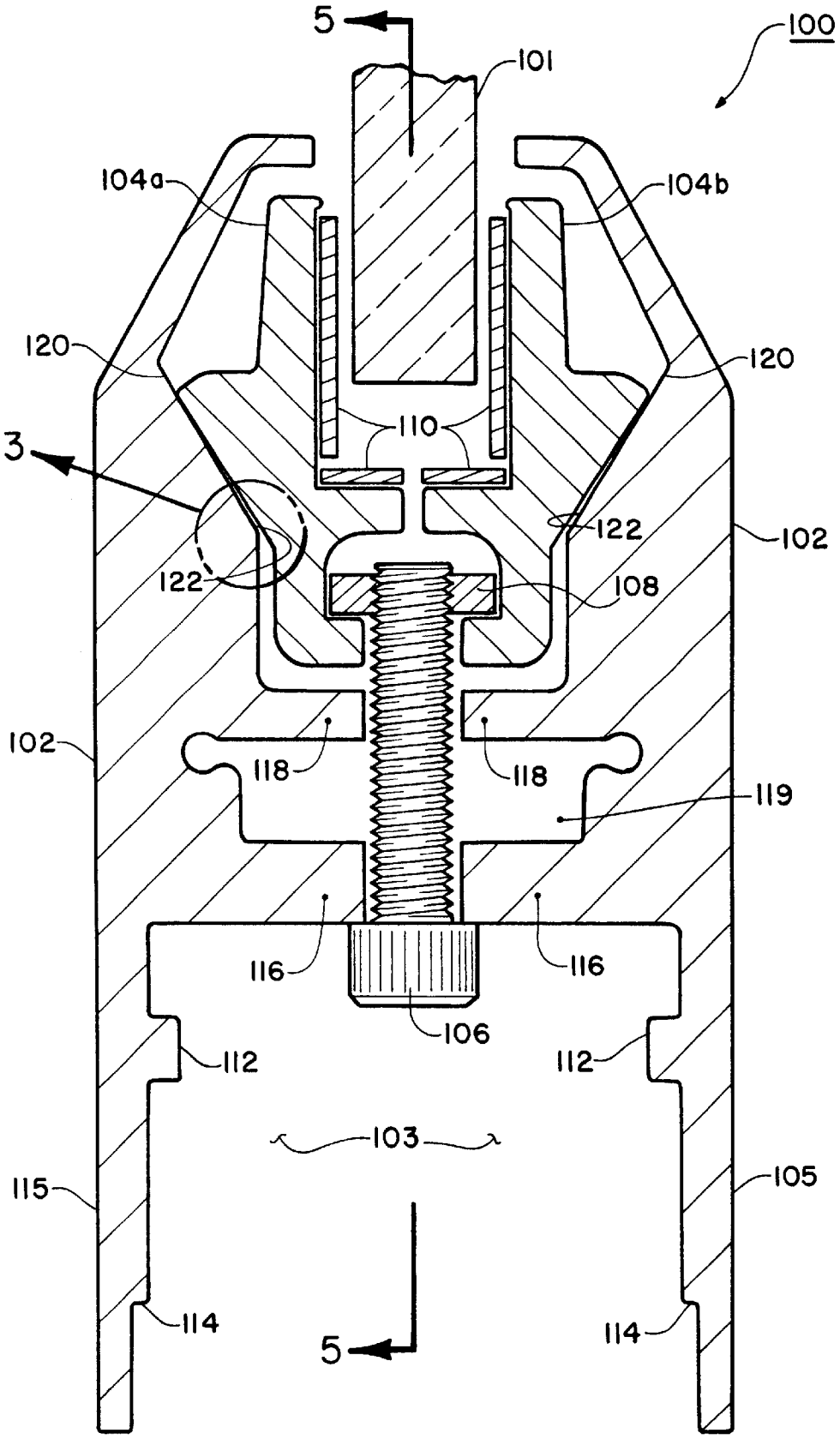
FIG. 2 is a transverse cross-sectional view of a first embodiment of a rail system according to the present invention.

FIGS. 2 to 11 illustrate a first exemplary rail system 100 according to the present invention. As shown in FIG. 2, rail system 100 includes pane 101, housing 102, first clamp member 104*a*, second clamp member 104*b*, screw 106, nut strip 108, pads 110 and end cap 130.

Pane 101 is preferably made of tempered glass, but may be alternatively may be a panel of any transparent, translucent or opaque material, such as acrylic or aluminum. Because pane 101 is preferably made of glass, it may be brittle, subject to warping and subject to uneven major surfaces. The present invention is helpful in providing secure and non-destructive clamping, despite these potential problems with glass panes.

Housing 102 is preferably formed of aluminum and is preferably manufactured by extrusion. Because the side surfaces of housing 102 will usually be exposed, it is preferable to use an attractive finish, such as satin anodize, black anodize or bronze anodize. Alternatively, conventional cladding, such as brass plates, may be placed over the exposed surfaces of housing 102 by conventional means, such as an adhesive. In some embodiments, housing 102 will run along the entire length and/or height of the door. Generally, glass doors only have rails at the top and bottom of the door. Wall partitions may have rails at the top, bottom and sides.

For example, many doors are about 3 feet in length, which would dictate a housing of approximately 3 feet in length. In other embodiments, such as patch fitting applications, the housing will be shorter. For example, a housing 9 inches in length may be preferred when the primary purpose of the rail system is to hold door closure accessories in its accessory channel space (as further explained below), because shorter rails are less expensive and are also thought to be more aesthetically attractive in some applications.

As shown in FIG. 2, the top portion of side surfaces of housing 102 are inclined inward with respect to the vertical direction defined by pane 101. Alternatively, the housing 102 may have other profiles for its side surfaces, such as square sides.

As shown in FIG. 2, channel walls 105 of housing 102 define accessory channel space 103. Accessory channel space 103 can be used to hold various door-related accessories, such as tumbler locks, end-loading arms, side-loading arms, pivots, sweeps and dust barriers.

Although the general concept of accessory channels was known in the prior art (see FIG. 1), accessory channel space includes features such as protrusions 112 and discontinuity 114 that help to secure accessories within the accessory channel. Also, as shown in FIG. 2, according to some embodiments of the present invention, accessory channel space 103 may be used to provide access to fastening hardware (e.g., screw 106), which means that aesthetically-detrimental access holes (such as hole so shown in FIG. 1) do not need to be cut in the side of the housing.

Figure 5:
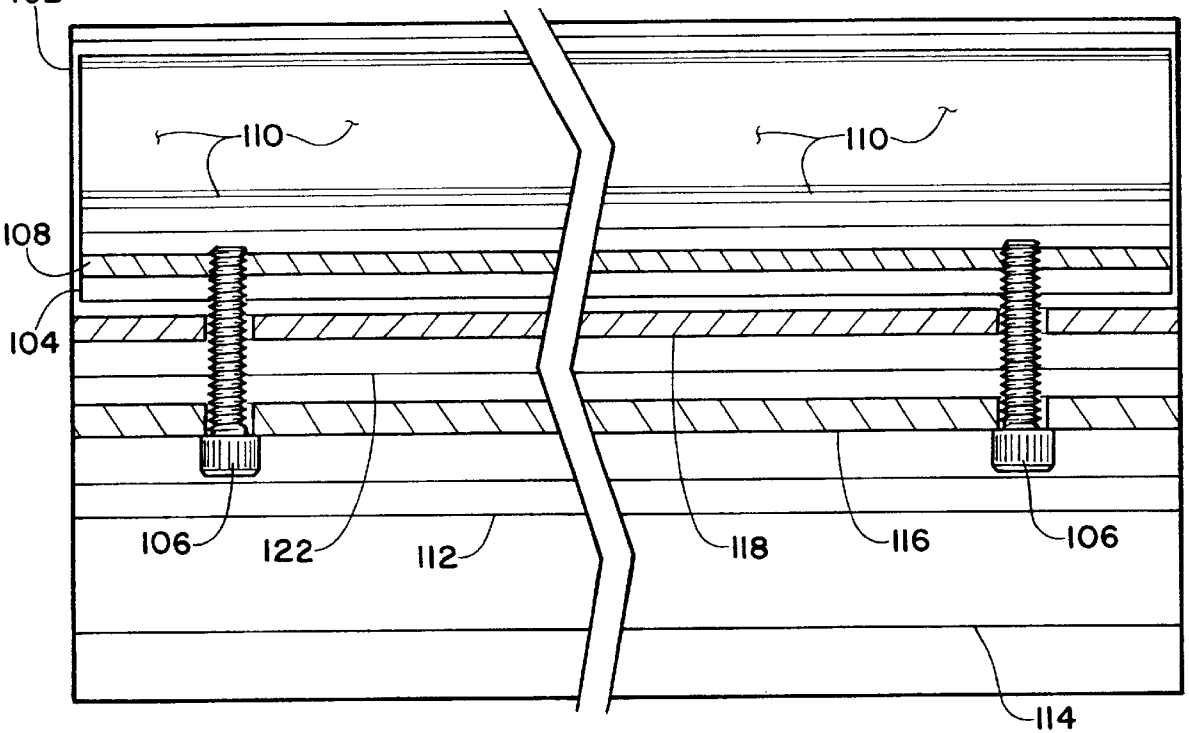
FIG. 5 is longitudinal cross-sectional view of the first embodiment rail system.
Figure 4:
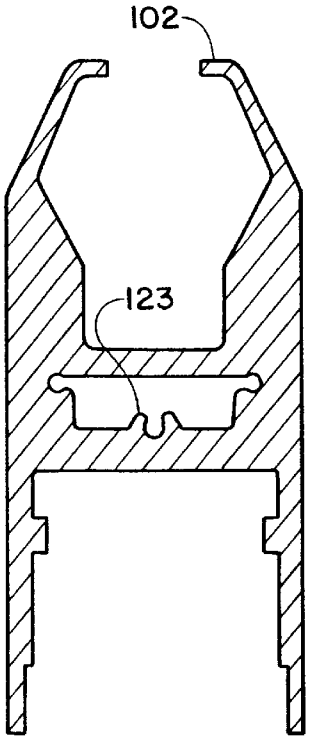
FIG. 4 is a cross-sectional view of the housing of the first embodiment rail system.
Figure 7:
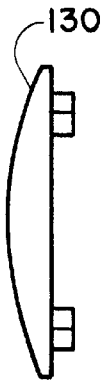
FIG. 7 is an end view of an end cap for use with the first embodiment rail system.
Figure 8:
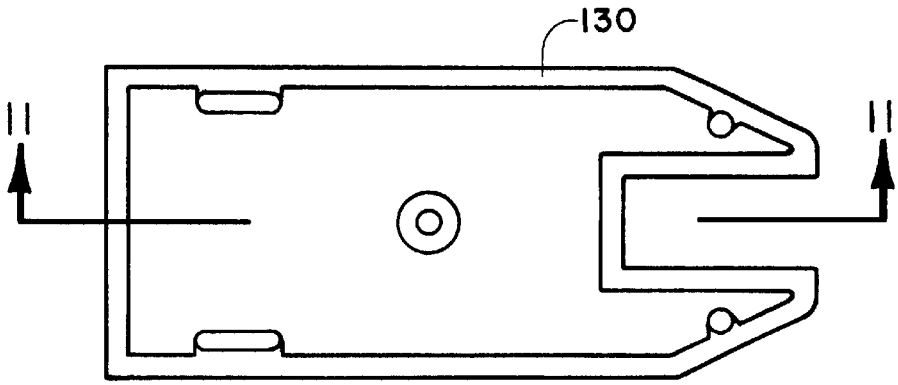
FIG. 8 is a bottom view of the FIG. 7 end cap.
Figure 9:
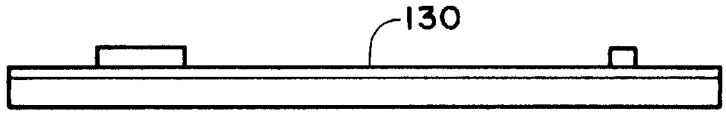
FIG. 9 is a side view of the FIG. 7 end cap.
Figure 10:
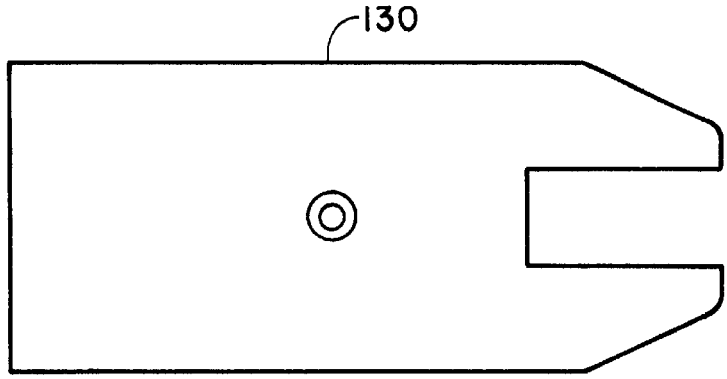
FIG. 10 is a top view of the FIG. 7 end cap.
Figure 11:
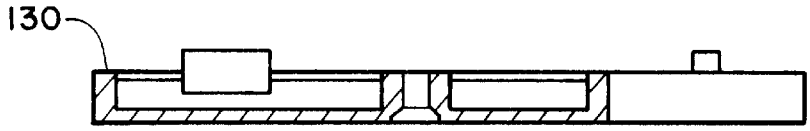
FIG. 11 is a cross-sectional view of the FIG. 7 end cap.

Compression member 116 of housing 102 defines the topside of accessory channel space 103. As shown in FIG. 5, holes are present at intervals in compression member 116 in order to accommodate screws 106. As shown in FIG. 2, screw 106 is tightened against the surface of compression member 116.

As shown in FIG. 2, housing 102 also includes tension member 118. As shown in FIG. 5, tension member 118 also has holes located at intervals to accommodate screws 106. Tension member 118 and compression member 116 define cavity 119. Cavity 119 includes screw grooves 123. The geometry formed by tension member 116 and compression member 118 is advantageous because it reduces weight of the housing (without a loss of structural integrity) and also helps with the formation of screw grooves 123.

As shown in FIGS. 2 and 5, first clamp member 104*a* and second clamp member 104*b* are disposed within housing 102 about either side of screw 106 and pane 101. The clamp members are preferably made of extruded aluminum. The clamp members are instrumental in providing the clamping forces on pane 101, as will be explained after the preferred make-up of the other hardware components is discussed.

Because clamp member 104 is formed as two pieces 104*a,* 104*b,* panes of various nominal thickness can be accommodated merely by varying the dimensions of housing 102 and/or pads 110, without changing the design of clamp members 104.

Screw 106 is preferably a bolt steel, socket head cap screw with a 1/4–28 thread, but it is noted that many other kinds of fasteners may be used. As with many clamping applications, threaded fasteners are the most preferred way of actuating the components to generate clamping forces, but, at least in theory, other fastening devices, such as ratcheting devices and rack-and-pinion devices could alternatively be employed.

Different types of screws may be preferable for various embodiments. For example, a flat head screw would occupy none of the space of accessory channel 103, and flat head screws may be preferred for applications where a flat head screw can sustain enough driver torque to secure the pane.

Figure 6:
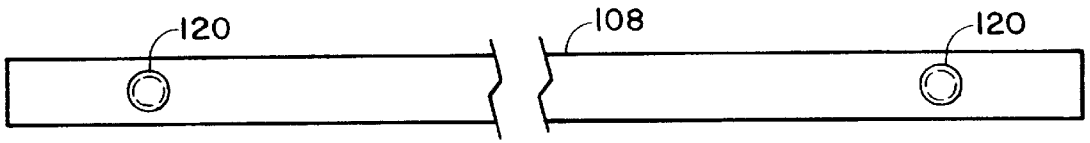
FIG. 6 is a top view of a nut strip of the first embodiment rail system.

As shown in FIGS. 2, 5 and 6, nut strip 108 is an elongated rectangular prism with threaded holes 120 drilled at intervals of (preferably) 5 or 6 inches. Preferably, the holes in nut strip 108 are drilled by securing nut strip 108 to housing 102 and simultaneously making holes both in first and second class members 116, 118 of housing 102 and in nut strip 108 so that matching holes for screws 106 will be well-aligned in longitudinal direction. Nut strip 108 is preferably made of stainless steel. While the unitary construction of nut strip 108 facilitates rail system assembly and helps maintain precise longitudinal spacing of screws 106, it is noted that discrete, conventional nuts could alternatively be used.

As shown in FIGS. 2 and 5, pads 110 are interposed between clamp members 104 and pane 101. Pads are preferably made of cork-rubber composite, neoprene, synthetic-based rubber (SBR), a fiber based elastomeric material or HAKOSIL (the word HAKOSIL may be subject to trademark protection). Pads 110 serve to accommodate warping and uneven surfaces of pane 101 and clamp members 104 and to more evenly distribute clamping force along pane 101. Preferably, pads 110 should be elastic and should be resistant to compression set and shrinkage. Also, the coefficient of friction of pads 110 should be adequate to grip the pane. Preferably, pads 110 are affixed to clamp members 104 by adhesive.

Various views of end cap 130 are shown in FIGS. 7 through 11. End cap 130 is secured at an end of housing 102 by screws, or, alternatively, by other means such as by a force fit or friction fit. End cap 130 provides an aesthetically-attractive, removable surface at the end of housing 102.

Now that the hardware components of rail system 100 have been discussed, the mechanics of the clamping of pane 101 will be explained. Generally speaking, according to the present invention the clamping force is generated by a wedge geometry so that a driving force in one direction causes a clamping force in a different direction.

For example, as shown in FIG. 2, screw 106 is tightened against first cross member 116 of housing 102 in order to pull nut strip 108 toward the head of screw 106 (herein called "the driven direction"). Preferably, screw 106 is target torqued to about 85 inch-pounds. In turn, nut strip 108 forces both clamp members 104 in the driven direction. However, because inclined surfaces 122 of clamp members 104 are in contact with inclined surfaces 120 of housing 102 and because of the inclination of these mating surfaces with respect to the driven direction, clamp members 104*a* and 104*b* are pulled toward each other in a clamping direction as they move in the driven direction. As clamp members 104*a* and 104*b* move toward each other, they generate forces in the clamping direction that clamp pane 101.

Although the geometry of rail system 100 is preferred for reasons further explored below, many other types of wedge geometries are possible. A couple of these will now be discussed.

Figure 12:
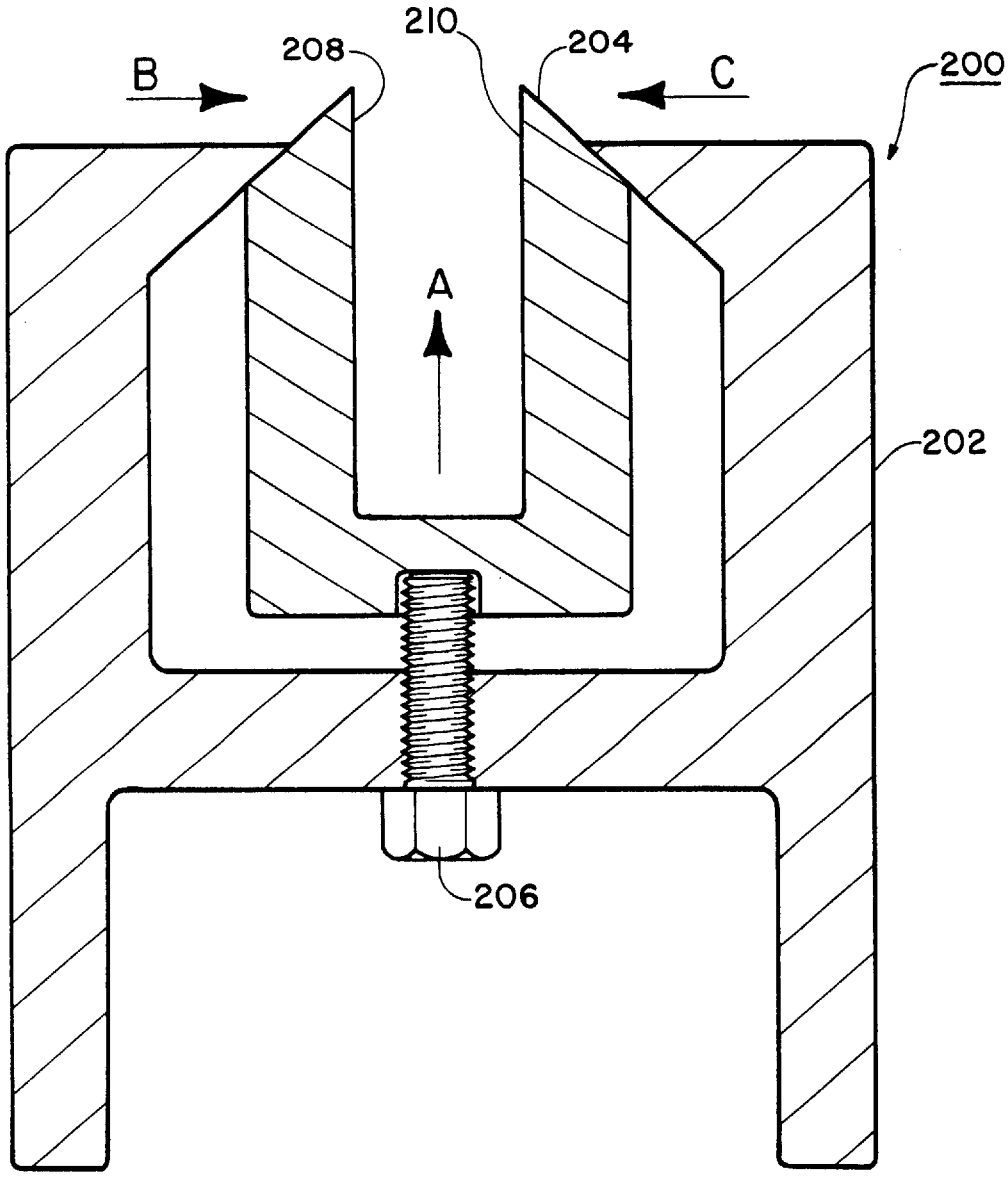
FIG. 12 is a transverse cross-sectional view of a second embodiment of a rail system according to the present invention.

FIG. 12 shows a second embodiment of a rail system 200 according to the present invention. Rail system 200 includes housing 202, clamp member 204 and screw 206. As screw 206 is tightened, it forces clamp member 204 to move generally in the driven direction of arrow A. Because housing 202 and clamp member 204 are in contact at surfaces inclined with respect to the screw-tightening direction A, this causes the arms 208, 210 of clamp member 204 to move toward each other (in the clamping directions respectively shown by arrows B and C) to provide clamping force on a pane (not shown). It is noted that this embodiment uses a unitary clamp member 204 that flexes to provide the clamping force, and that the driven direction is oriented toward the pane, rather than away from it (as seen in the FIG. 2 embodiment).

Figure 13:
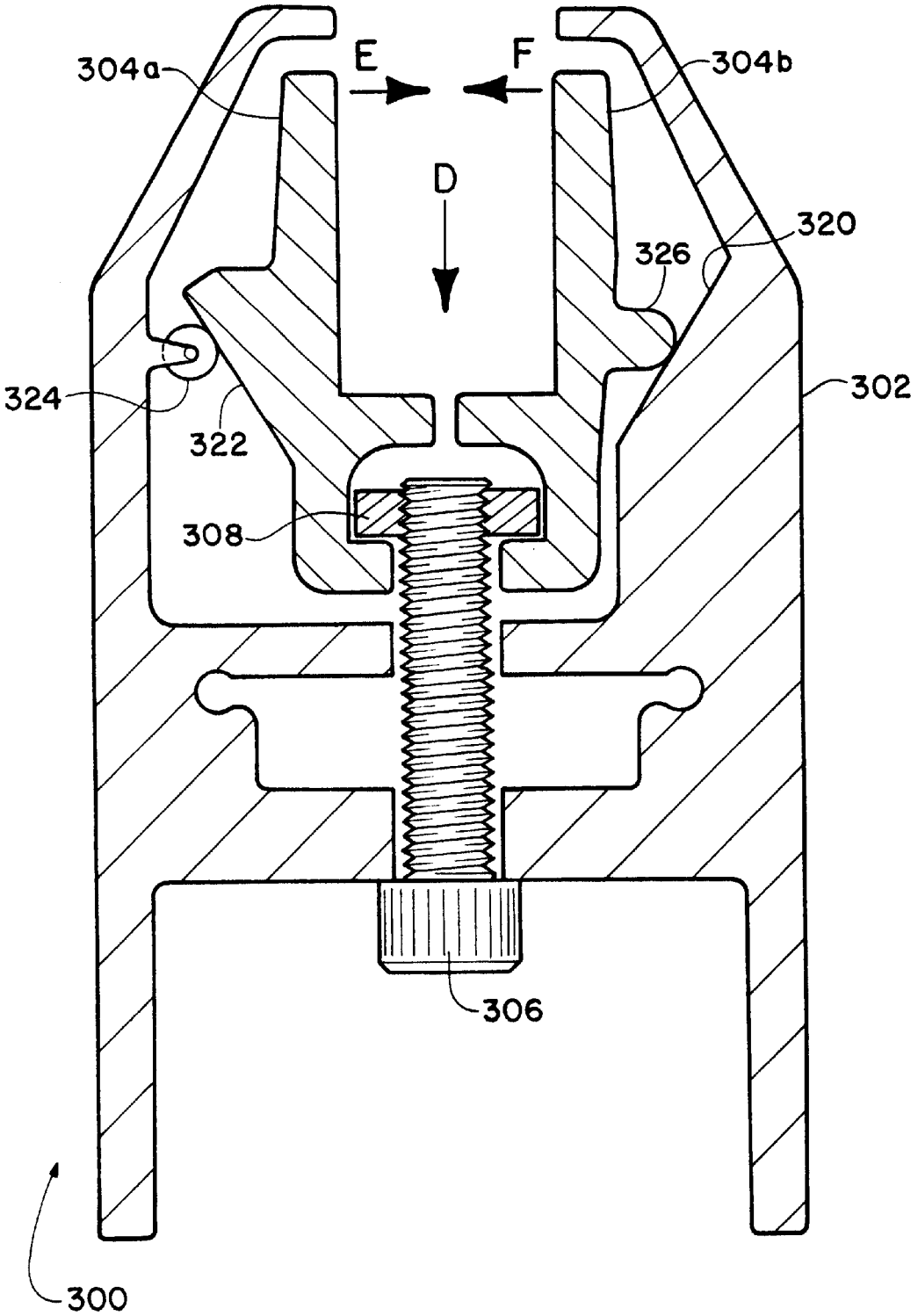
FIG. 13 is a transverse cross-sectional view of a third embodiment of a rail system according to the present invention.

FIG. 13 shows a third embodiment of a rail system 300. While rail system 300 is not a preferred embodiment, it does serve to illustrate some of the breadth of variation possible in effecting clamping by uses of inclined surfaces according to the present invention. Rail system 300 includes housing 302, first clamp member 304*a,* second clamp member 304*b* and screw 306. Screw 306 is tightened to force nut strip 308 in the driven direction indicated by arrow D. This in turn forces clamp members 304 to move in driven direction D.

When first clamp member 304*a* moves in driven direction D, contact between its inclined surface 322 and roller 324 (which is built into housing 302) forces first clamp member 304*a* to move by translation and/or rotation in the clamping direction of arrow E to clamp down on a pane (not shown). While the roller 324 would add expense and potential structural weakness, it could potentially: (1) reduce wear on housing 302 and clamp member 304*a;* and (2) guide an irregular and/or curved inclined surface on clamp member 304*a*. Such an irregular or curved inclined surface might be employed to optimize the correlation between driving torque on screw 306 and eventually-effected clamping force exerted by clamp member 304*a* on the pane. Roller 324 also serves to illustrate that an inclined surface on the housing is not necessary, if there is an inclined surface on clamp member 304*a*.

Moving now to the other side of rail assembly 300, when second clamp member 304*b* moves in screw tightening direction D, contact between its sliding surface 326 and inclined surface 320 of housing 302 forces second clamp member 304*a* to move by translation and/or rotation in the clamping direction of arrow F to clamp down on a pane (not shown). Sliding surface 326 serves to illustrate that an inclined surface on the clamp member is not necessary, if there is an inclined surface on the housing.

Figure 3:
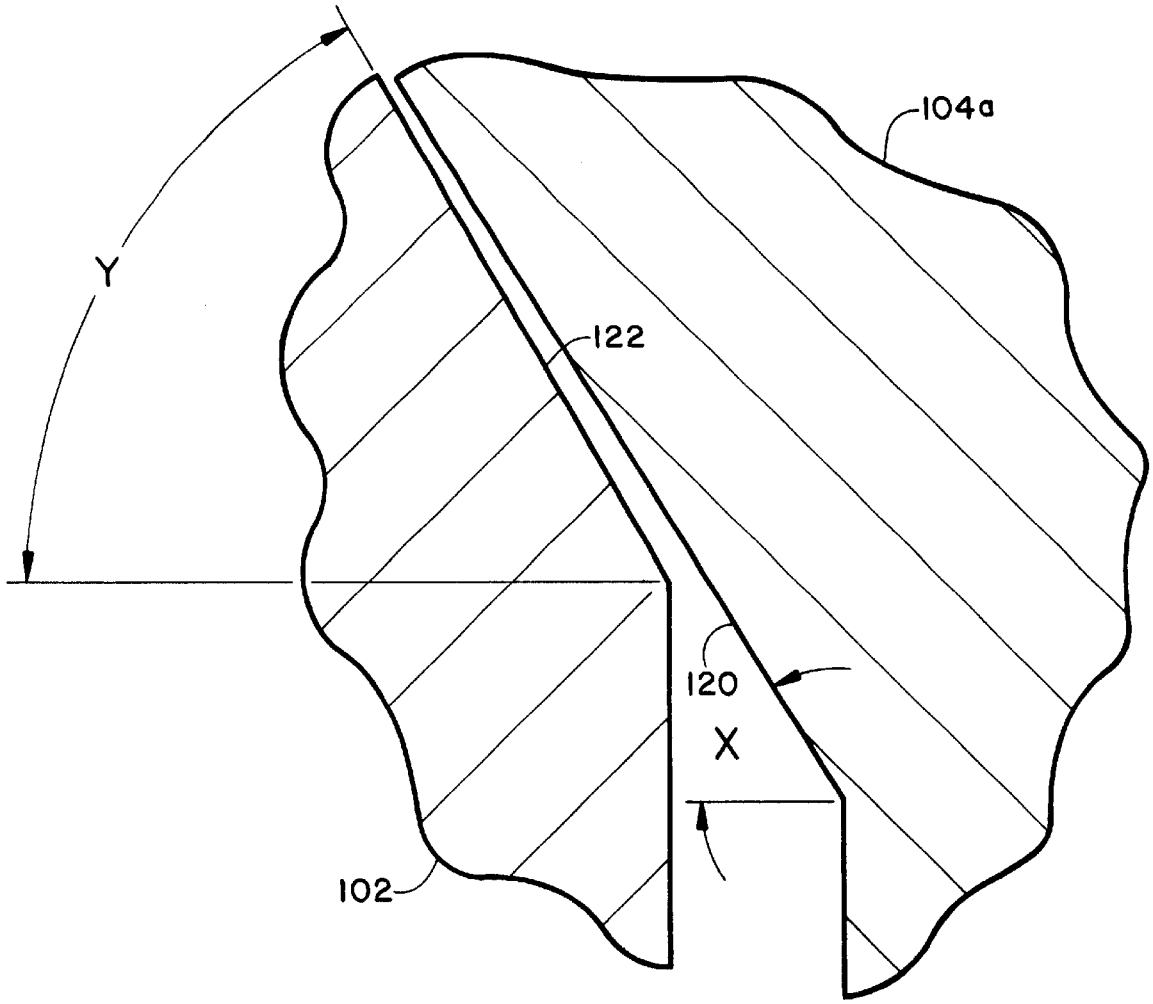
FIG. 3 is a magnified view of a portion of the cross-sectional view of FIG. 2.

Now that some possible variations have been explored, the focus will return to the first embodiment of FIGS. 2 and 3 so that some of the specific advantages of this preferred embodiment can be explained. As shown in FIG. 2, mating, inclined surfaces 120 and 122 are close to parallel, but not exactly parallel. As shown in the magnified view of FIG. 3, inclined surface 120 is inclined at angle X from the horizontal direction, while inclined surface 122 is inclined at a slightly steeper angle Y from the horizontal. More particularly, angle X is preferably 59 degrees, while angle Y is preferably 60 degrees.

However, wide variation in angles X and angle Y, as well as in the difference between angle X and angle Y, are possible. Different choices for these angles and for the difference between these angles can be used to optimize: (1) the correlation between driving torque of screw 106 and clamping force; and (2) the distribution of clamping force along pane 101.

One advantage of mating inclined surfaces is that a phenomenon called taper lock occurs, to some extent, between housing 102 and clamp members 104. The taper lock phenomenon, effected by relatively long contacting inclined surfaces, helps secure clamp members 104 in position relative to housing 102 and helps prevent screw 106 from loosening once it is tightened to the correct tightness.

Furthermore, the clamping force provided by clamp members 104 is thought to be provided by a combination of translational and/or rotational motion. The relative amounts of rotation and translation will affect the distribution of clamping force over the clamped surface of the pane. As optimal distribution of clamping force is discovered, the angles of inclination of the wedge-clamping geometry of the present invention will give designers a powerful design mechanism for tweaking the clamping force distribution. This is another advantage of at least some embodiments of the present invention.

Another advantage of the geometry of FIG. 2 is that the weight of pane 101, which may be considerable, will help force clamp members 104 in the screw-tightening direction, which in turn will provide more clamping force on the pane. This self-locking phenomenon helps to secure the pane, at least at the bottom rail.

This advantage of self-tightening, at the bottom rail, actually is a fairly important advantage and will now be explained. At least with some embodiments of the rail system of the present invention, in order to tighten the screws of the top rail, one must merely open the door and tighten the screws by coming in from over the top of the door rail through the accessory channel. However, the floor will generally block the open bottom to the accessory channel of the bottom rail, and will thereby block access to the screws. This is generally true whether the door is in the open or closed position, because the bottom of a door generally stays pretty close to the floor at all times. That means that when the bottom rail screws need tightening, the door must be taken out of the frame and then replaced after the screws are tightened.

However, in embodiments of the present invention that have self-tightening screws, this operation needs to be perfrmed less frequently, or not at all, at the bottom rail. Therefore, it can be a pretty big benefit to have a self-tightening bottom rail, even when the top rail needs to be tightened from time to time.

There are effective limits on the angles of inclination X and Y shown in FIG. 3. If angles X and Y are less than about 10 degrees, it may be difficult to generate sufficient clamping force for a given amount of driving torque on screw 106. On the other hand, if the angles X and Y are greater than about 85 degrees, then it may become difficult to assemble and/or disassembled rail assembly 100.

Still another advantage is that housing 102 is unitary, even though the clamp members 104 move within this unitary housing 102 to clamp and unclamp panes. The main advantage of this unitary housing is that hardware residing in accessory channel 103, which is defined by unitary housing 102, can remain in place within housing 102 while the housing is assembled with and disassembled from a pane. This is not true of removable rail systems where the housing itself must be disassembled into halves in order to clamp and unclamp a pane. If the housing is disassembled, then components in the accessory channel must generally be disassembled from one or more housing components to allow disassembly of the housing. Therefore, the unitary housing of the present invention can save significant time required for assembly and disassembly.

Many variations on the above-described jamb assemblies are possible, such as mating jamb and fascia surfaces with various different shapes of splines, protrusions, grooves or other mating surfaces that facilitate attachment there between. Such variations are not to be regarded as a departure from the spirit and scope of the invention, but rather as modifications intended to be encompassed within the scope of the following claims.

What is claimed is:

1. A rail system for releasably securing a pane having at least one major surface defining a first plane, the rail system comprising:

an elongated housing comprising:

a first inclined surface oriented to be generally inclined with respect to the first plane; and a second inclined surface oriented to be generally inclined with respect to the first plane;

a first clamp member comprising:

an inclined surface located adjacent to the first inclined surface of the housing and oriented to be approximately parallel to the first inclined surface of the housing; and a pane clamping surface;

a second clamp member comprising:

an inclined surface located adjacent to the second inclined surface of the housing and oriented to be approximately parallel to the second inclined surface of the housing; and a pane clamping surface;

a screw; and a nut threadably engaged with the screw and located to drive the first and second clamp members in a direction along the first plane in order to generate sufficient opposing clamping forces between the first clamp member and the second clamp member such that a pane can be secured between the pane clamping surface of the first clamp member and the pane clamping surface of the second clamping member;

wherein the nut is an elongated strip having at least two threaded holes.

2. The rail system of claim 1 wherein a portion of the nut strip is located adjacent to the first clamp member, and a portion of the nut strip is located adjacent to the second clamp member.

* * * * *